US006877824B2

(12) United States Patent
Winkless

(10) Patent No.: US 6,877,824 B2
(45) Date of Patent: Apr. 12, 2005

(54) MODULAR FURNITURE

(76) Inventor: Christine Elizabeth Winkless, 1491 Safeway Dr., Mississauga, Ontario (CA), L4X 1H8

( * ) Notice: Subject to any disclaimer, the term of this patent is extended or adjusted under 35 U.S.C. 154(b) by 0 days.

(21) Appl. No.: 10/369,666

(22) Filed: Feb. 21, 2003

(65) Prior Publication Data

US 2004/0164653 A1 Aug. 26, 2004

(51) Int. Cl.[7] ..... A47B 87/02; F16B 12/00

(52) U.S. Cl. ..... 312/107; 312/111

(58) Field of Search ..... 312/107, 111, 312/198, 203, 257.1

(56) References Cited

U.S. PATENT DOCUMENTS

| | | | | | |
|---|---|---|---|---|---|
| 224,486 | A | * | 2/1880 | Spruce | 312/107 |
| 713,534 | A | * | 11/1902 | Thurnau | 312/107 X |
| 762,328 | A | * | 6/1904 | Lundstrom | 312/107 |
| 764,839 | A | * | 7/1904 | Casler | 312/107 |
| 1,029,466 | A | * | 6/1912 | Schaffert | 312/111 X |
| 1,115,996 | A | * | 11/1914 | Wilson | 312/107 |
| 1,122,278 | A | * | 12/1914 | Jackson et al. | 312/107 |
| 1,221,948 | A | * | 4/1917 | Young | 312/107 |
| 1,252,816 | A | * | 1/1918 | Kuehl | 312/107 |
| 1,306,728 | A | * | 6/1919 | Ulrich | 312/107 |
| 1,331,862 | A | * | 2/1920 | Claus | 312/111 X |
| 1,573,608 | A | * | 2/1926 | Huffman | 312/107 |
| 1,656,868 | A | * | 1/1928 | Davis et al. | 312/111 X |
| 2,386,343 | A | * | 10/1945 | Regenhardt | 312/111 |
| 2,573,602 | A | * | 10/1951 | Regenhardt | 312/111 |
| 2,582,553 | A | * | 1/1952 | McMurtrie | 312/111 X |
| 3,000,680 | A | * | 9/1961 | Zelenko | 312/111 |
| 3,219,400 | A | * | 11/1965 | Bergquist | 312/107 |
| 3,446,544 | A | * | 5/1969 | Serwer | 312/111 |
| 3,506,321 | A | * | 4/1970 | Heinz | 312/107 |
| 3,514,170 | A | * | 5/1970 | Shewchuk | 312/107 |
| 3,529,878 | A | | 9/1970 | Blowers | 312/107 |
| 3,552,579 | A | * | 1/1971 | Simon et al. | 312/111 X |
| 3,552,817 | A | * | 1/1971 | Marcolongo | 312/107 |
| 3,563,624 | A | * | 2/1971 | Stice | 312/111 |
| 3,644,008 | A | | 2/1972 | Overby | 312/107 |
| 3,746,416 | A | * | 7/1973 | Sasnett et al. | 312/198 |
| 3,836,217 | A | * | 9/1974 | Shiina | 312/107 |
| 3,841,725 | A | * | 10/1974 | Dorner | 312/107 |
| 3,851,936 | A | * | 12/1974 | Muller | 312/111 X |
| 4,130,971 | A | * | 12/1978 | Herrig | 312/111 X |
| 4,423,913 | A | * | 1/1984 | Lee | 312/107 |
| 4,819,567 | A | * | 4/1989 | Thompson et al. | 312/111 X |
| 4,974,386 | A | * | 12/1990 | Eriksson et al. | 312/111 X |
| 5,054,863 | A | * | 10/1991 | Amstutz et al. | 312/111 |
| 5,058,964 | A | * | 10/1991 | Reuschel et al. | 312/111 |
| 5,137,340 | A | * | 8/1992 | Cugley et al. | 312/107 X |
| 5,147,120 | A | * | 9/1992 | Ray | 312/111 |
| 5,486,041 | A | * | 1/1996 | Sykes | 312/111 |
| 5,492,399 | A | * | 2/1996 | Tillack | 312/111 |

(Continued)

FOREIGN PATENT DOCUMENTS

| | | |
|---|---|---|
| DE | 165701 | 4/1905 |
| GB | 302506 | 12/1928 |
| WO | WO 92/05724 | 4/1992 |

OTHER PUBLICATIONS

Smarte.com; Solutions; http://www.smarte.com/module-files/magazinesolutions/solutions_032001.cfm.

*Primary Examiner*—Rodney B. White
(74) *Attorney, Agent, or Firm*—Marks & Clerk

(57) ABSTRACT

A system for modular furniture is provided, consisting of a plurality of modules, each having a front wall, a back wall, a left wall, a right wall, a top wall and a bottom wall, the top wall having a recess and the bottom wall having at least one projection corresponding to and operable to fit within and securely engage the recess when a first of the modules is vertically stacked atop of a second of the modules. The modules can be interengagingly and securely stacked either directly atop other modules or staggered atop two or more others to provide a desired configuration. A number of adapters can be used with the modules to provide a number of customized solutions.

9 Claims, 14 Drawing Sheets

U.S. PATENT DOCUMENTS 5,562,332 A * 10/1996 Stacy ..... 312/107
5,666,713 A * 9/1997 Kubota ..... 312/111 X
5,775,046 A * 7/1998 Fanger et al. ..... 312/107 X
6,003,924 A * 12/1999 Nicol et al. ..... 312/111 X
6,102,219 A * 8/2000 Wang ..... 312/111 X
6,578,937 B1 * 6/2003 Thoman ..... 312/107

* cited by examiner

MODULAR FURNITURE

FIELD OF THE INVENTION

The present invention relates generally to modular furniture. More specifically, the present invention relates to a system of reconfigurable basic units forming furniture.

BACKGROUND OF THE INVENTION

Modular furniture generally refers to furniture that is assembled from a number of basic modules that, in combination, provide the functionality required. The basic modules can be configured by a user to provide a number of configurations. Each configuration can vary in terms of size, utility, design, color, etc. The finished product is typically permanently fastened together in the desired configuration and deployed. While these traditional modular furniture systems allow for a customized configuration that is suited for a specific environment, taste, budget, they do not generally allow for rapid dynamic reconfiguration of the furniture to suit immediate needs.

More recently, a number of modular furniture solutions have appeared on the market wherein the modules can be configured to suit a number of requirements and are generally not fastened together with any permanency. The modules are generally box-like, having four lateral walls, a bottom and a top. The top typically has a set of features that correspond to a set of complementary indentations in the bottom.

One such system is disclosed in U.S. Pat. No. 3,644,008 (Overby), whereby a set of complementary box portions are fitted together to form storage cabinets of different shapes. A number of different basic modules are required to construct a complete piece of furniture as additional modules rely on existing structure to complete the boxes that provide the storage spaces. A first module used to start the furniture product has five closed sides. A second module stacked atop of it or placed beside it has four closed sides, relying on the shared closed side of the first module to provide a fifth closed side to the second module. Each edge of the second module in contact with the first module has a complementary feature to allow for the second module to interlockingly engage the first module. Subsequent additional modules need have three to four closed sides and must be selected accordingly to correspond to the existing structure already laid out. As with the second module, the edges of contact of each additional module added to the product interlockingly engage the current structure. Each of the boxes of the completed product have an open lateral face that is aligned with those on the other modules to provide a number of storage spaces accessible from a front side of the product.

While Overby's system provides for modular furniture that is relatively easily disassembled, the constructs do not possess the structural strength required for a number of furniture items. Additionally, the modules can only be stacked one directly atop another, thus allowing a shearing force applied along a seam of the structure to pull the modules apart. Further, the finished product is marred by a number of projections and indentations.

Another such system is disclosed in WO 92/05724 (O'Neill et al.), whereby a set of box-like modules are provided with four or more circular projections on the top of one module that correspond to holes in the bottom of an adjacent module. Each of the modules is equipped with a drawer, thus making the system suitable for constructing chests of drawers and desk pedestals. While O'Neill contemplates that the circular projections on the top surface of the uppermost module can be left exposed for decoration purposes, he does note that a number of applications, such as for a desk, it is desirable to place an adapter over the upper surface of the stacked modules. The adapter is generally a working surface having holes, either through bores, where the circular projections are visible on the working surface, or blind bores, where the projections are hidden from view. Further, O'Neill discloses additional board adapters having a number of circular projections on an upper surface corresponding to those found on the top of the modules. This second group of adapters are to be placed below a stack of modules, providing stability to certain furniture combinations such as a two-pedestal desk where adapters underlie and overlie the two stacks of modules to stabilize the structure.

While the system disclosed by O'Neill allows the modular furniture to be rapidly reconfigured to suit varying immediate needs, it suffers from a relatively high cost of manufacture in that the circular projections generally must be machined and affixed to the top of the module and bores must be made in the bottom of each module. Further, O'Neill only discloses that the modules are essentially vertically stacked to create the required structures.

Another system for modular furniture comprised of a number of cubes having either one open or doored lateral wall. The cubes are typically constructed of wood or wood products and can be stacked as required to match a space or storage requirement. The cubes themselves, however, do not have any interlockingly engaging features to stabilize a completed product. Further, no method for securing laterally placed modules is available, thus allowing the structure to shear horizontally.

Accordingly, there is a need for a system for providing modular furniture that can be adapted to provide a number of furniture products. Further, there is a need for modular furniture that, when formed into a furniture product, is stable.

SUMMARY OF THE INVENTION

In an aspect of the invention, there is provided a system for providing modular furniture, comprising: a plurality of modules, each having a front wall, a back wall, a left wall, a right wall, a top wall and a bottom wall, the top wall having at least one recess and the bottom wall having at least one projection corresponding to and operable to fit within and securely engage the recess when a first of the modules is vertically stacked atop of a second of the modules.

In an implementation of the aspect, the modules have one the recess, preferably substantially centrally located in the top wall.

The recess can define a lip around a perimeter of the top wall of the module.

In an implementation of the aspect, the modules have at least two projections from the bottom wall with at least one channel between the projections operable to receive portions of two or more lips of adjacent modules, such that the first module is operable to securely engage the lips within the channel when the first of the modules is stacked atop of two or more additional modules.

The at least one projection can be dimensioned to allow one of the modules to be placed atop and securely engage the recesses of at least two other of the modules. Further, at least one functional adapter can be used with the modules, wherein the at least one functional adapter is operable to securely engage the recess of at least one module. The at least one functional adapter can be a retainer clip, a seat adapter, a mattress support adapter, a headboard adapter, a table adapter, a desk adapter, a finishing adapter, a lateral cover adapter, or a crib adapter.

Further, a base projection frame can be used in conjunction with one or more modules, the frame being operable to fit around the base projections of the one or more modules. Where the base projection frame is operable to fit around the base projections of two or more of the modules, the frame can restrict horizontal movement of the modules.

In another aspect of the invention, there is provided a modular furniture component, comprising: a front wall; a back wall; a left wall; a right wall; a top wall having at least one recess; a bottom wall having at least one projection corresponding to and operable to fit within and securely engage the recess of another component. The recess can define a lip around a perimeter of the top wall.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
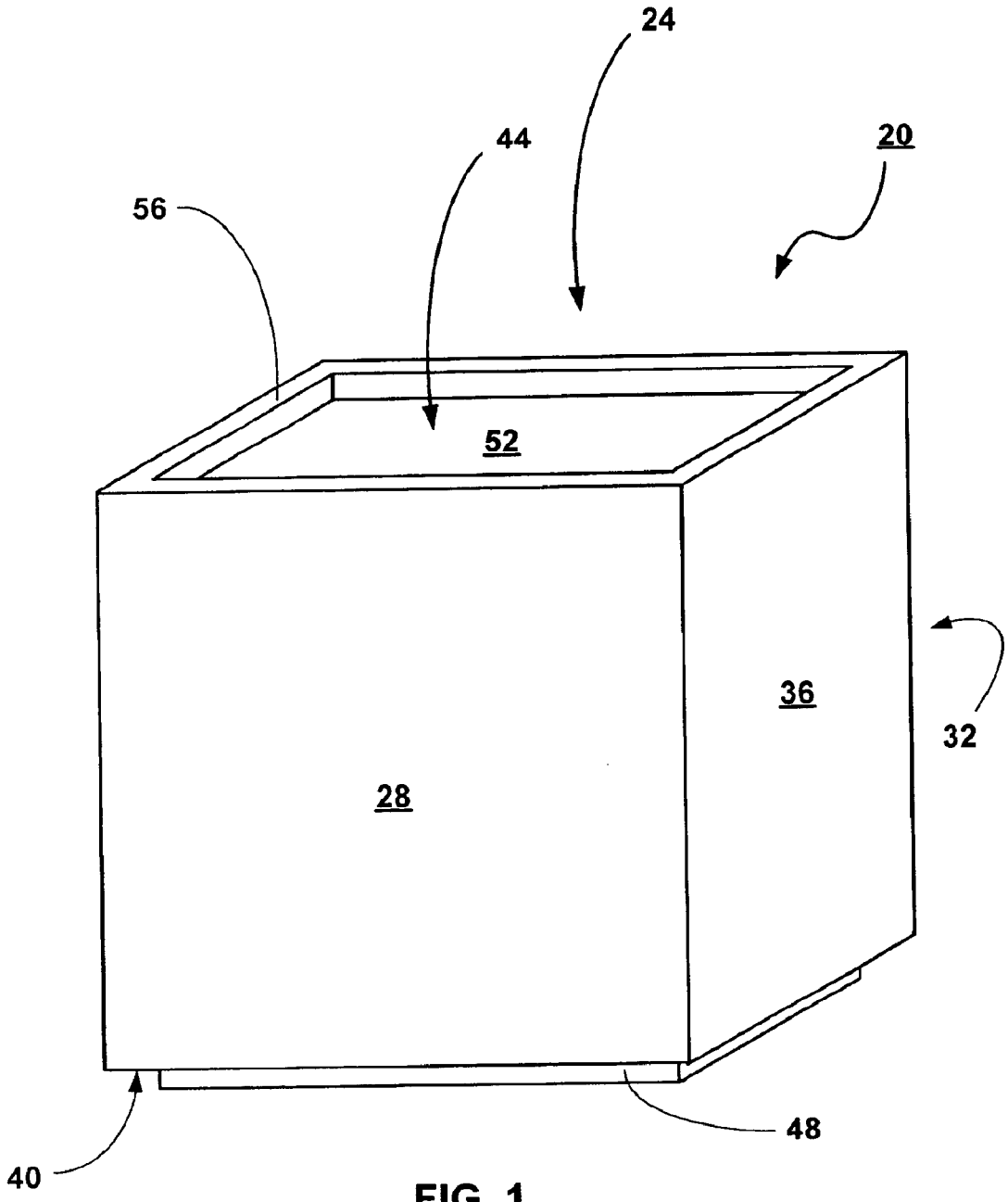
FIG. 1 is a perspective view of a module in accordance with an embodiment of the invention.

A module for providing modular furniture in accordance with an embodiment of the invention is generally shown at 20 in FIG. 1. Module 20 has a top wall 24, a front wall 28, a back wall 32, two side walls 36, and a bottom wall 40. In the embodiment shown in FIG. 1, module 20 is generally cubic, but other variations will occur to those skilled in the art that are suitable for side-by-side placement and stacking, such as a box-like structure having a length, a width and a depth of different lengths. Top wall 24 has a recess 44. Bottom wall 40 has a base projection 48 corresponding to recess 44, allowing modules 20 to be stacked one atop another.

In the embodiment shown in FIG. 1, recess 44 has a one-inch depth and has a cross-area defined by a perimeter offset one inch from the outer perimeter of module 20, thus defining a sub-top wall 52 and a lip 56. Correspondingly, base projection 48 is like-dimensioned, having a depth of one inch and a cross-area defined by a perimeter offset one inch from the outer perimeter of module 20. When modules 20 are stacked one atop another, base projection 48 of one module fits snugly in recess 44 of another module.

Module 20 can be constructed of wood, wood product, paper product, plastics, metal, or any other suitable material that provides the required structural integrity and can be moved by a person. Further, module 20 can be a composite of a number of materials. For example, a metal frame can be fitted with paperboard or plastic walls to provide a specific style. In a present embodiment, module 20 is constructed of one-inch particle board and has a void formed therein.

Figure 2:
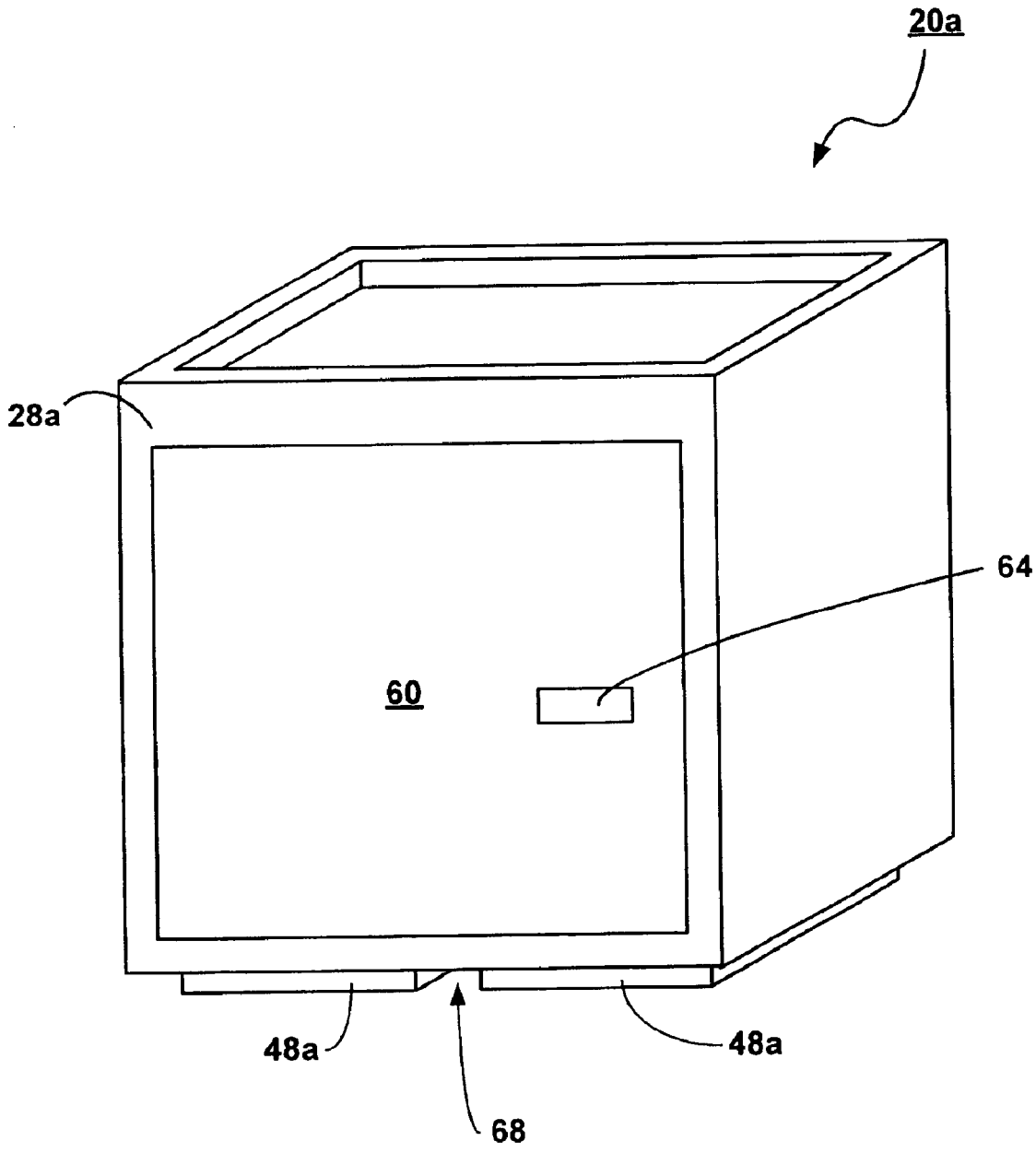
FIG. 2 is a perspective view of a module in accordance with another embodiment of the invention.

FIG. 2 shows a module 20*a* in accordance with a variation of the embodiment of FIG. 1, wherein storage is provided inside module 20*a* and is accessible by means of a door 60 in front wall 28*a*. Door 60 is operable via a handle 64. Further, a pair of base projections 48*a* are shown, similar to base projection 48 of FIG. 1, but having a channel 68 between base projections 48*a*. Channel 68 is dimensioned to receive lips 56 of two modules 20 that are laterally abutting such that module 20*a* can be securely placed atop two modules 20 wherein each of base projections 48*a* is positioned within a recess 44 of separate modules 20. This staggered stacking configuration allows for increased structural integrity of a combined module structure when two or more vertical rows of modules 20 are deployed.

Where modules 20 are generally box-shaped, modules 20 can be constructed of different dimensions. In a present embodiment, modules 20 share a common width and height, but have varied widths to allow for staggered stacked configurations and other configurations that are adaptable to the particular circumstances of the user. Other variations of the dimensions of modules 20 will occur to those of skill in the art.

Figure 3:
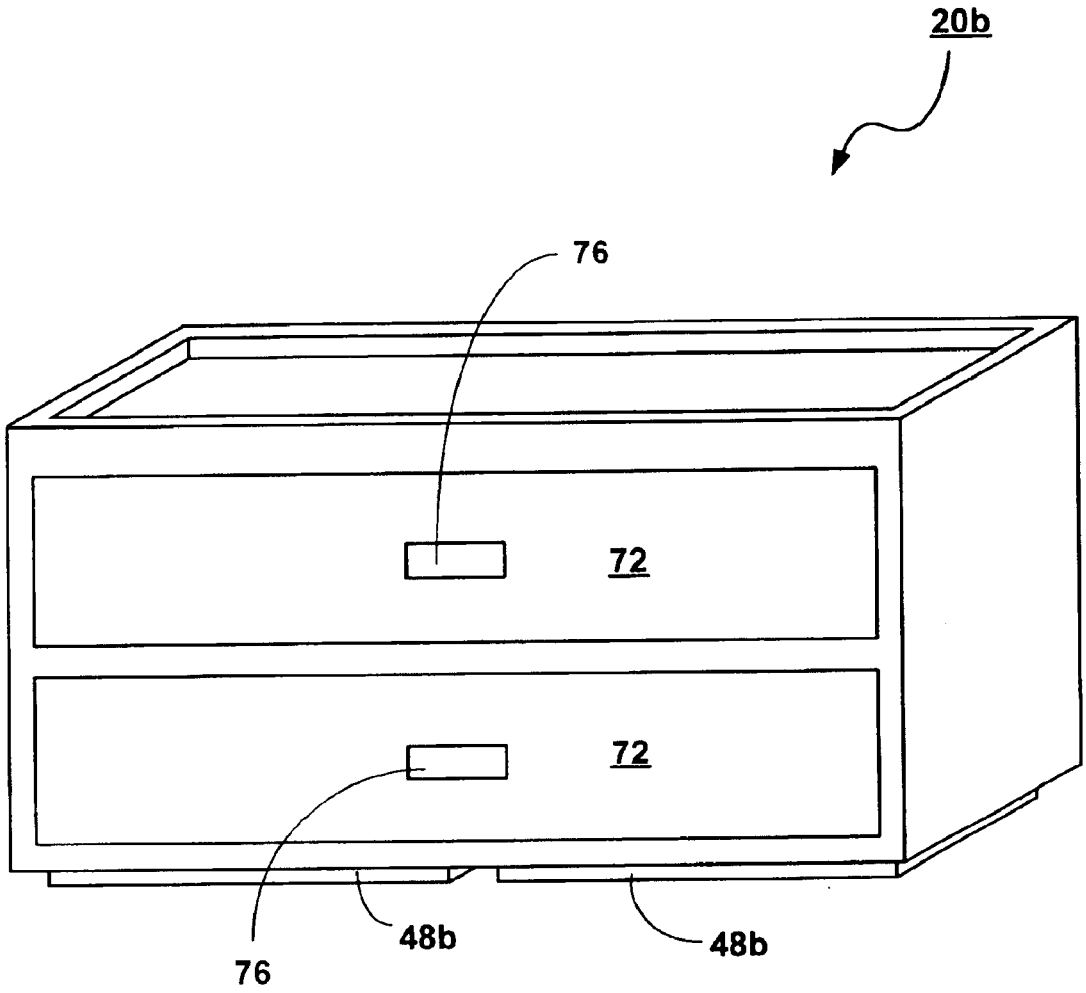
FIG. 3 is a perspective view of a module in accordance with another embodiment of the invention.

FIG. 3 shows a variation of the module suited for staggered stacking and providing wide drawer space desired by some users. Module 20*b* has a length of 36 inches, and a width and height of 18 inches. Module 20*b* is shown having two base projections 48*b*, again similar to those found on module 20*a*, thus allowing module 20*b* to be readily stacked atop of two other appropriately sized modules. Module 20*b* is shown having two slide-out drawers 72 having handles 76.

Figure 4:
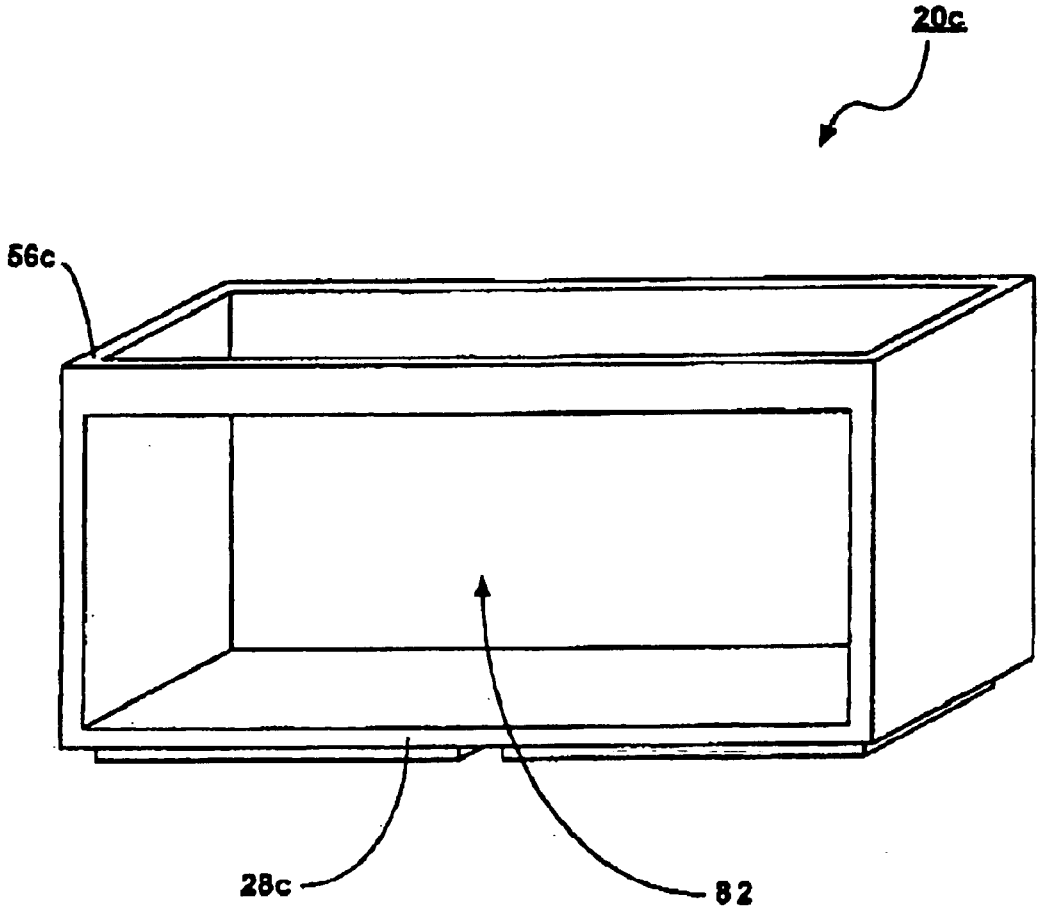
FIG. 4 is a perspective view of a module in accordance with another embodiment of the invention.

FIG. 4 shows a further alternate embodiment of the invention, whereby module 20*c* is similarly dimensioned to module 20*b*, but has a storage space 82 accessible via an opening in front wall 28*c*. Further, the sub-top wall is not present, thus allowing access to storage space 82 from the top of the module. When modules 20 are placed atop of module 20*c*, their base projections 48 depend in recess 44*c* and modules 20 are supported by the peripheral portion of bottom wall 40 of module 20 resting on lip 56*c* of module 20*c*.

Figure 5:
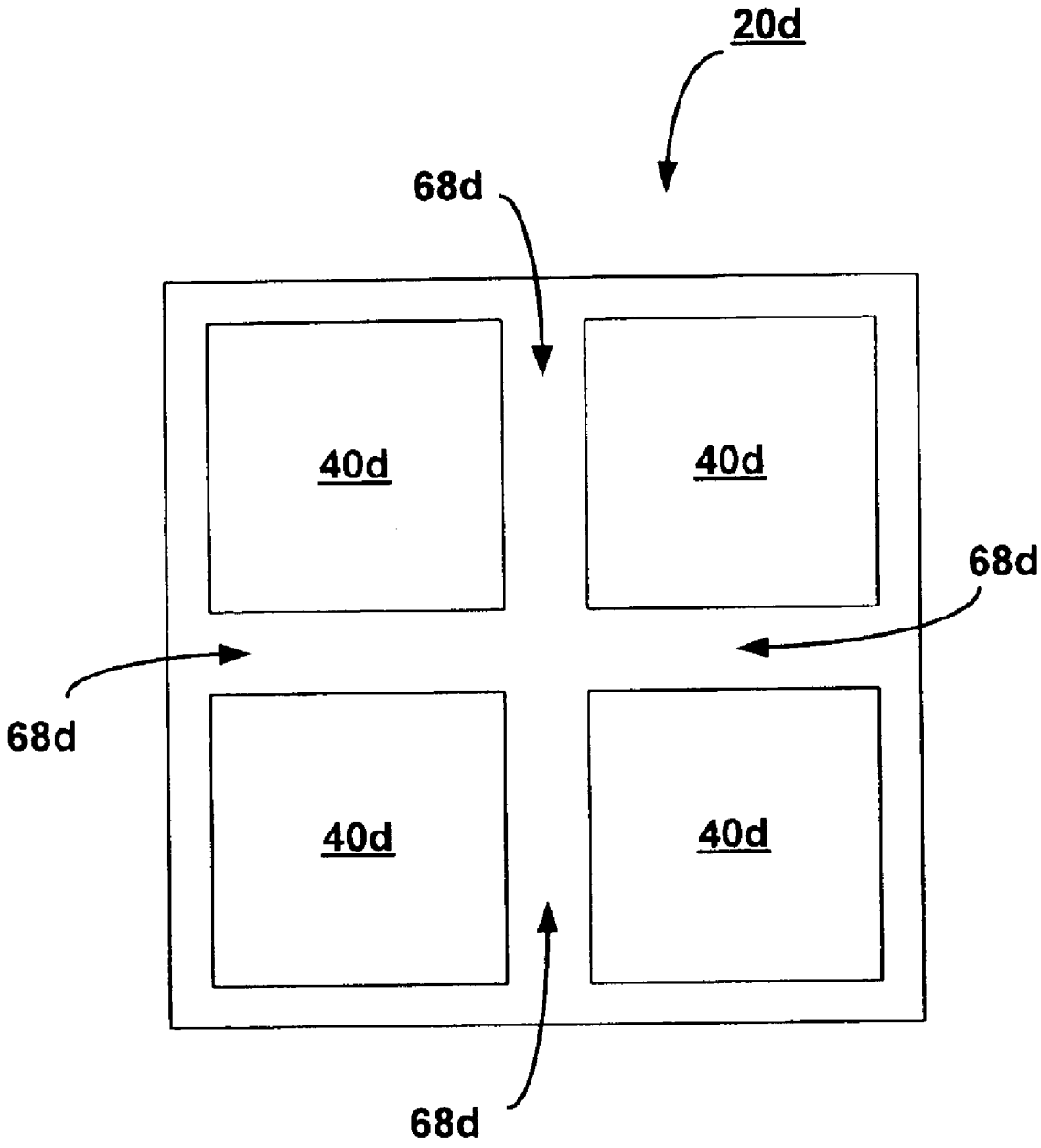
FIG. 5 is a bottom view of the bottom wall of a module having four base projections in accordance with another embodiment of the invention.

FIG. 5 shows a bottom view of a module 20*d* in accordance with a variation of that shown in FIG. 2. In particular, four base projections 48*d* project from bottom wall 40*d*, defining four channels 68*d* that are each dimensioned to securely receive two adjacent lips 56 of four modules 20 that are laterally abutting such that module 20*a* can be securely placed atop the four modules wherein each of base projections 20*d* is positioned within a recess 44 of separate modules 20. This base projection configuration allows module 48*d* to be placed centrally over four abutting modules. Such a module 20*d* can also be operably deployed stacked on two modules such that the lips of the two modules correspondingly mate with two parallel channels 68*d*. Other variations of channels 68 and base projections 48 for use with modules of various dimensions will be apparent to those of skill in the art.

Figure 6:
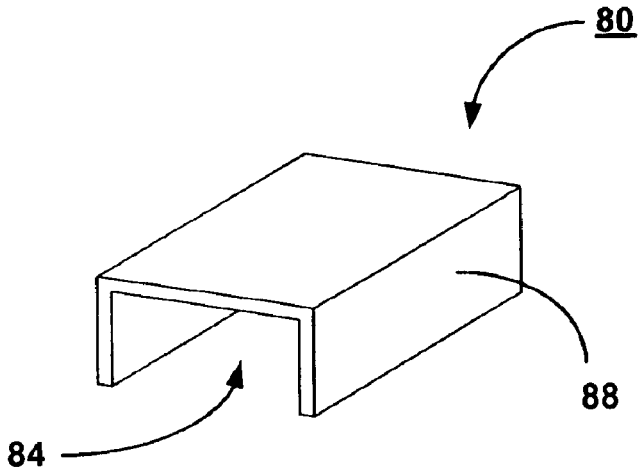
FIG. 6 is a perspective view of a retainer clip for use with two modules.
Figure 7:
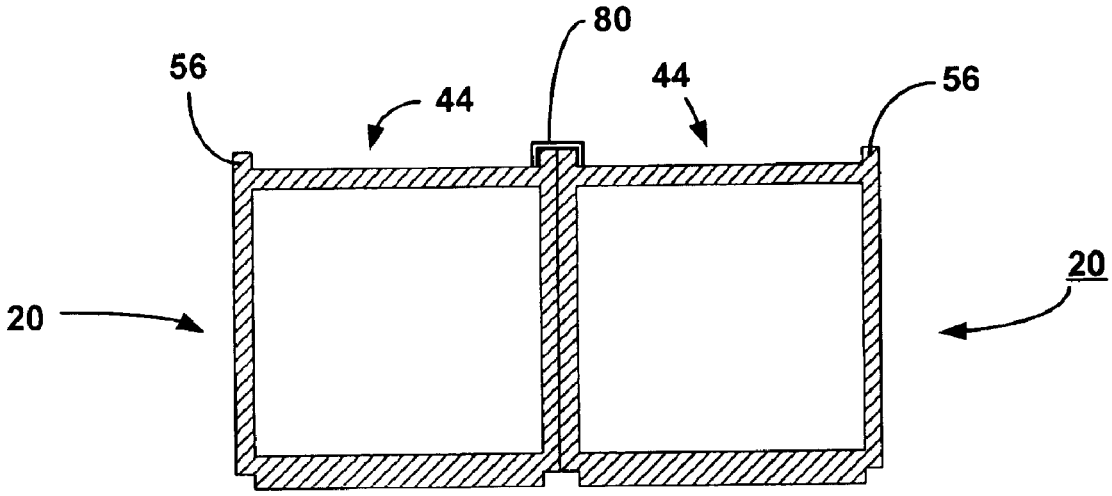
FIG. 7 is a sectional view of a retainer clip deployed on two laterally abutting modules.

A retainer clip 80 for use with modules 20 is shown in FIGS. 6 and 7. In accordance with an embodiment, as shown in FIG. 6, retainer clip 80 has a c-shaped cross-section, having a retaining channel 84 formed by flanges 88 and dimensioned to receive and retain lips 56 of two modules 20 upon placement thereover. In an implementation of the embodiment, retainer clip 80 is constructed of a rectangle of sheet metal crimped slightly over 90 degrees to create flanges that slightly extend towards one another, requiring a slight force to deploy retainer clip 80 over lips 56 and enabling retainer clip 80 to securely grip lips 56. The metal is preferably thin enough to allow the base projection of a module to be fitted into the recess of a module on which the retainer clip is placed, yet strong enough to provide the laterally abutting modules with the appropriate structural rigidity. Other materials and dimensions for constructing retainer clip 80 will occur to those of skill in the art. Further, it is contemplated that the lips might preferably have corresponding indentations to allow the retainer clip to be recessed therein and even flush therewith.

A cross-sectional view of two modules 20 abutting laterally is shown in FIG. 7, each having a recess 44 defining a lip 56. Retainer clip 80 is shown deployed over two lips 56 of the two modules 20.

A number of adapters can be constructed for use with modules 20 to extend their functionality. These adapters are preferably removably securable to modules 20 so that new furniture items can be configured from and dismantled to their basic elements quickly. As such, the adapters preferably are operable to securely interlock with modules 20 without the need for fasteners such as nails or screws.

Figure 8:
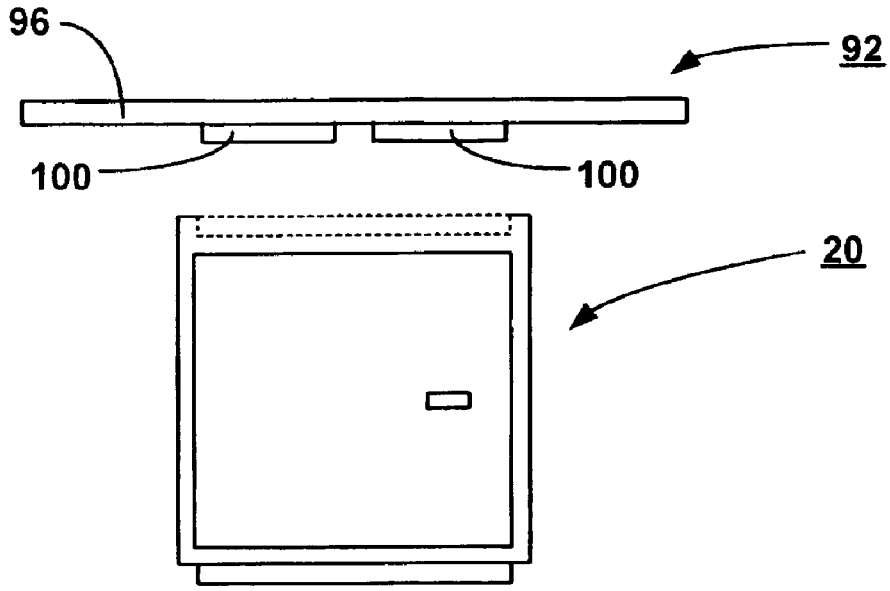
FIG. 8 is a front view of a table adapter deployed on a module.

FIG. 8 shows a table adapter 92 for use with modules 20 to co-operatively form a table. In this case, adapter 92 is a working surface 96 having one or more base projections 100 extending from a bottom surface thereof. The shown example illustrates base projections 100 that are not unlike those of FIGS. 2, 3, 4 and 5, allowing table adapter 92 to be deployed over a number of configurations of modules 20. Working surface 96 is dimensioned to provide a substantial working surface, yet be stable when retained by base projections 100 to one or more modules 20.

Figure 9:
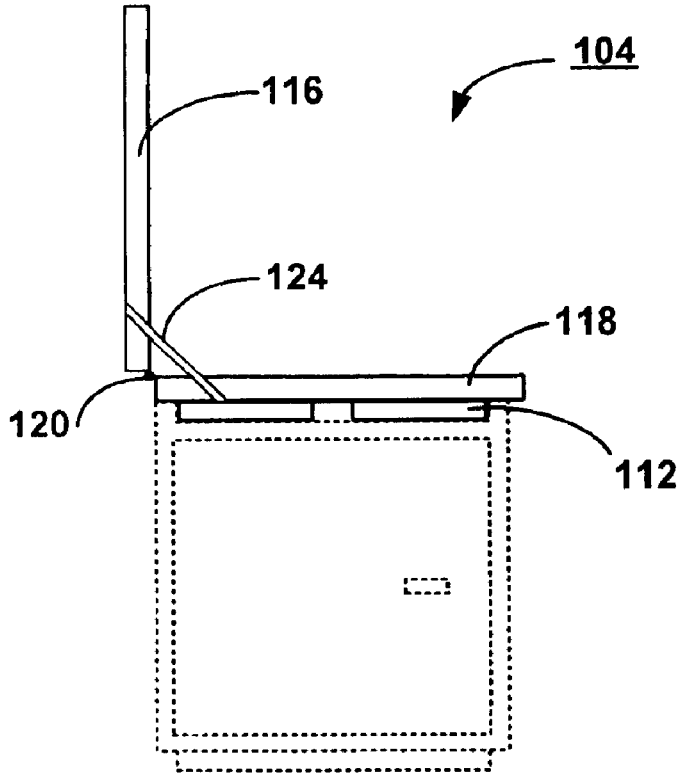
FIG. 9 is a side view of a seat adapter deployed on a module.

FIG. 9 shows a seat adapter 104 for use with modules 20. Seat adapter 104 is comprised of a seat board 108 having one or more base projections 112 extending from a bottom surface thereof. A back board 116 is connected to seat board 108 via one or more hinges 120 that allow seat adapter 104 to be folded for storage when not in use. Back board 116 can be limited from rotating back beyond a pre-determined reclining angle by a restraining strap 124 constructed of non-elastic material, such as cotton, that is secured to both seat board 108 and back board 116. Alernatively, any other method known to those skilled in the art for restricting the rotation of back board 116 can be employed, such as a hinge that limits rotation to a pre-determined angle.

Figure 10:
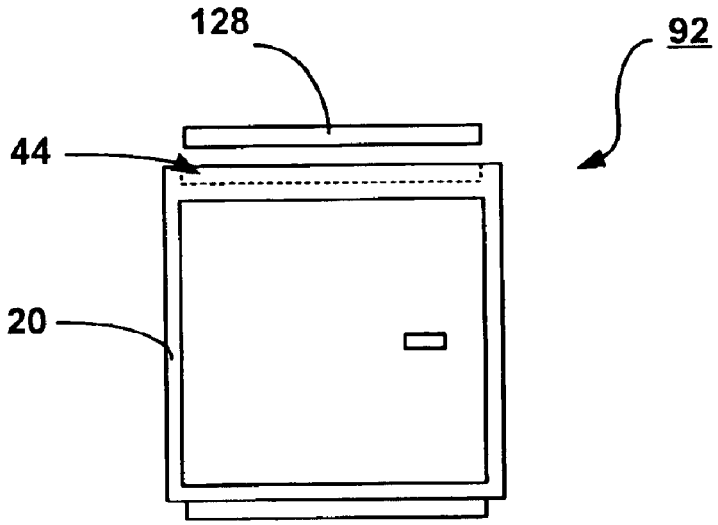
FIG. 10 is a front view of a finishing adapter being deployed on a module.
Figure 11:
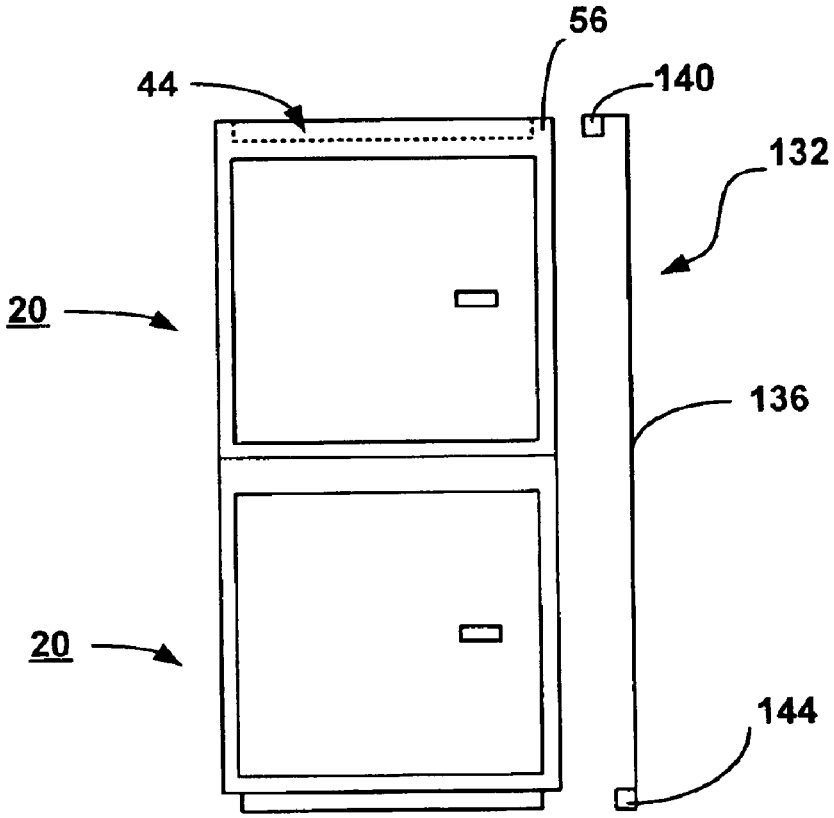
FIG. 11 is a front view of a lateral cover adapter being deployed on a pair of modules stacked one atop another.

FIG. 10 shows a finishing adapter 128 for use with a single module 20. In a present embodiment, finishing adapter 128 is dimensioned to generally fit and fill recess 44, providing module 20 a flush upper surface of top wall 24. Finishing adapter 128 either preferably is of the same general color as module 20 or can be colored contrastingly for decorative purposes. Further, finishing adapter 128 can be sized slightly smaller than recess 44, allowing finishing adapter 128 to be removed by overturning module 20. Alternatively, finishing adapter can be furnished with a feature, such as an indentation on a side thereof, allowing it to be removed from module 20 when in an upright position.

Where modules 20 are to provide a means of separating areas of a floor, such as their employment in an office environment for defining cubicles, a lateral cover adapter can be deployed over the modules, providing a customizable finish to a lateral side thereof. FIG. 11 shows a present embodiment of lateral cover adapter 132, wherein lateral cover adapter 132 is comprised of a lateral cover 136 depending from a top retaining means 140 and operable to be held securely over the sides of modules 20 using a bottom retaining means 144. Lateral cover 136 can be an industrial-grade fabric not unlike those used in the construction of commercially-available cubicle walls spanning a pre-determined length to cover one or more modules when depending from top retaining means 140. Alternatively, lateral cover can be any desired covering for modules 20 known to those skilled in the art, such as a mirror or corkboard. Top retaining means 140 can be a bar sized to fit in recess 44 and operable to retain lateral cover adapter 132 over the sides of modules 20. Where top retaining means 140 is a bar, top retaining means 40 can be constructed of metal, wood, or any other suitable material known to those skilled in the art that would operably rest in recess 44 and retain the upper end of cover adapter 132. Bottom retaining means 144 is also a bar dimensioned to be placed snugly under bottom wall 40 beside base projection 48. Bottom retaining means 144 might also be a hollow pipe through which wires or cables can be fed. It is understood by those of skill in the art that lateral cover adapter can also be operable to be fitted over front walls or back walls of modules 20.

Figure 12:
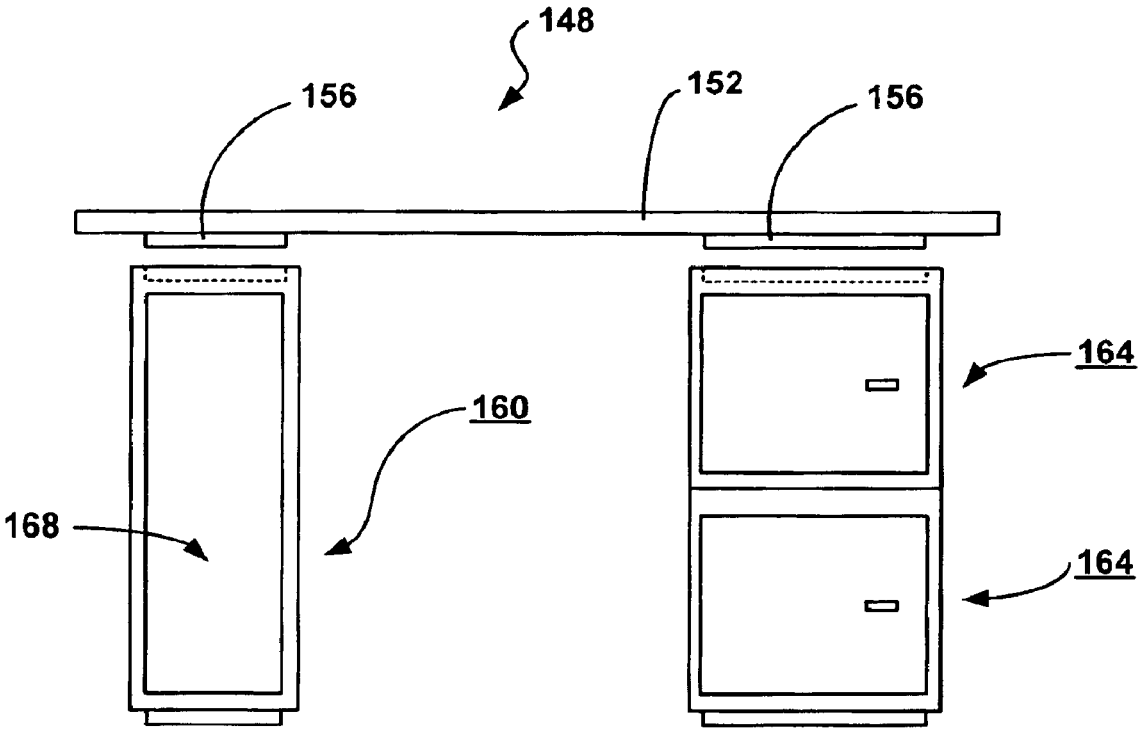
FIG. 12 is a desk constructed of a working surface adapter placed atop two pedestals constructed of modules.

FIG. 12 illustrates a working surface adapter 148 having a working surface board 152 and a pair of base projections 156. Working surface adapter 148 can be placed atop of and span two pedestals of modules to form, in this case, a desk. Computer tower cabinet module 160 forms one pedestal, having a height equal to that of two other modules 164 that are stacked to form the other pedestal. Cabinet module 160 has a computer tower hole 168 accessible through an aperture in the front wall and back wall of cabinet module 160 into which a computer tower can be fitted and allowing cabling to extend from the tower's back side.

Figure 13:
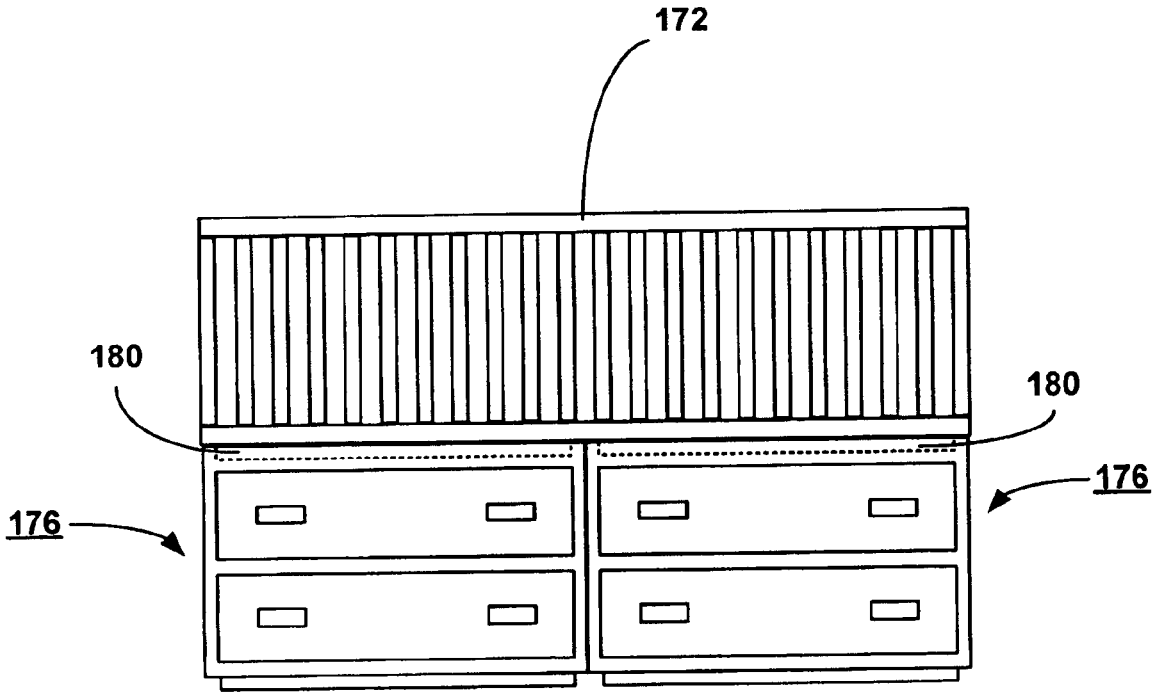
FIG. 13 is a crib adapter deployed atop modules.

A crib adapter 172 is shown, in FIG. 13, stacked atop two modules 176. Crib adapter 172 has two base projections 180 that fit into the recesses of modules 176 and can be quickly removed from atop of modules 20 to be placed on a flat surface to form a playpen.

Figure 14:
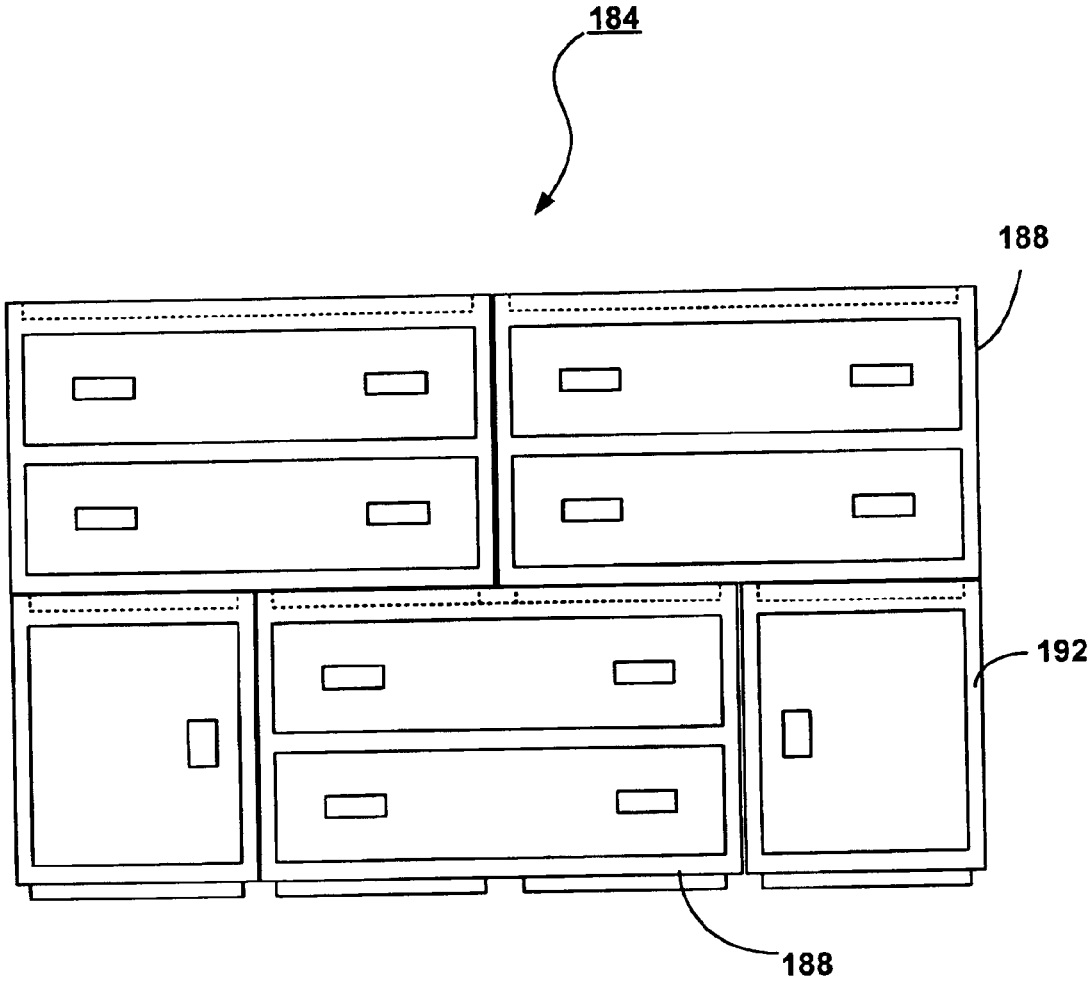
FIG. 14 is a storage unit comprised of staggered stacked modules.

FIG. 14 shows a number of modules combined to form a staggered-drawer storage unit 184. Storage unit 184 is formed from drawer modules 188 and cabinet modules 192. As shown, cabinet modules 192 have the same height as two drawer modules 188 stacked one atop another. By staggering the stacking of the upper drawer modules 188 such that they span a portion of the lower drawer modules 188 and cabinet modules 192, the structural strength of the configuration is increased.

Figure 15:
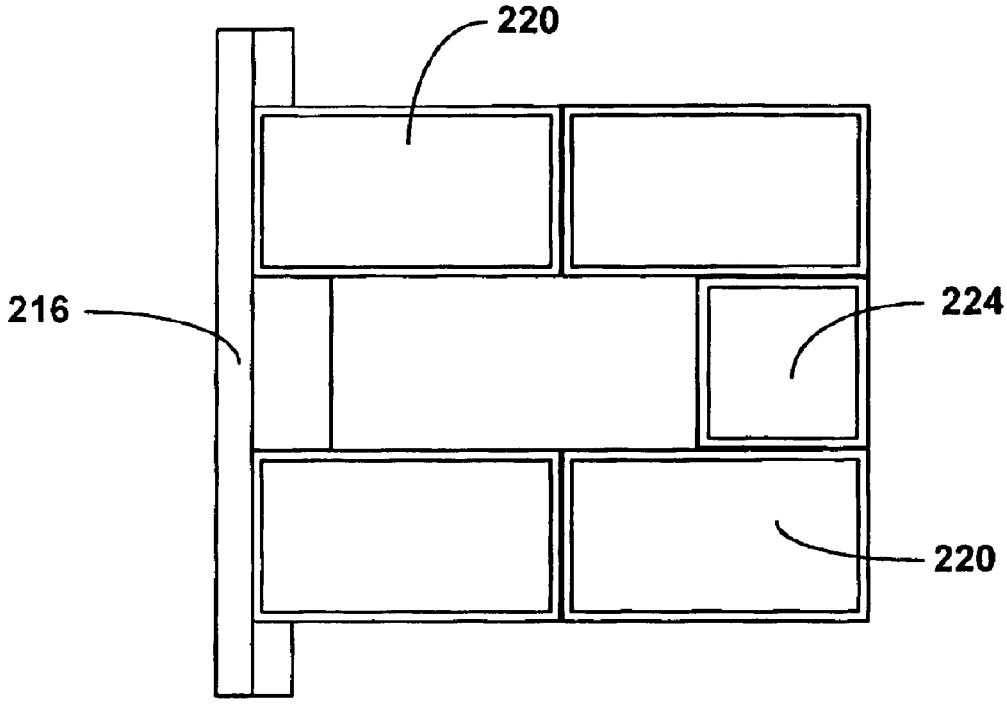
FIG. 15 is a top view of a bed frame configuration of modules and a headboard adapter.
Figure 16:
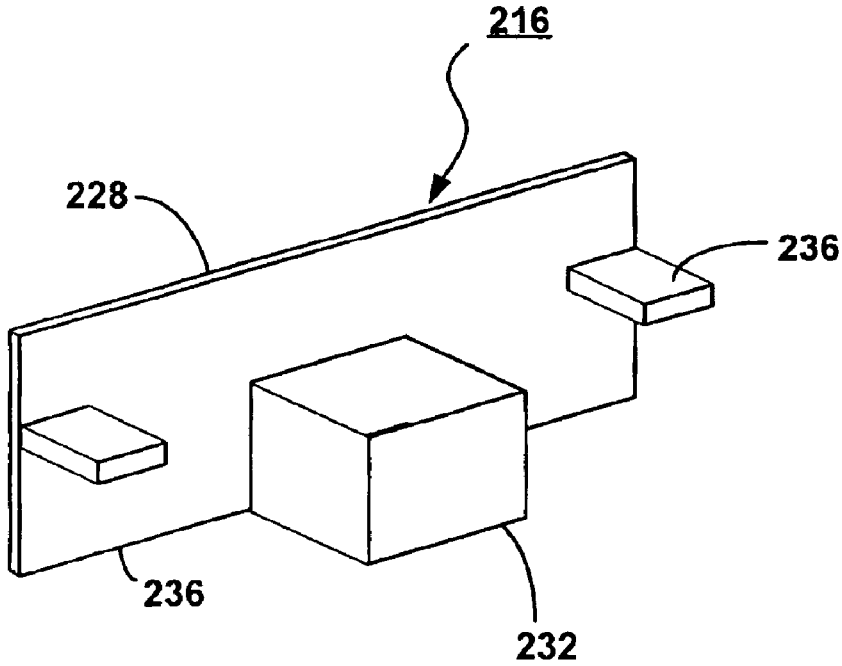
FIG. 16 is a perspective view of the headboard adapter.

FIG. 15 shows a headboard adapter 216 for use with the modules to form a bed. To form the base for the bed, two parallel rows of two side modules 220 aligned end-to-end are separated by a foot module 224. Headboard adapter 216 is then secured to a pair of side modules 220. As shown in FIG. 16, headboard adapter 216 consists of a headboard 228 onto which a spacer 232 of equal width to foot module 224 is mounted to space side modules 220. A pair of bed shelves 236 project from headboard 228. When deployed, headboard 228 and spacer 232 rest on the ground.

Figure 17:
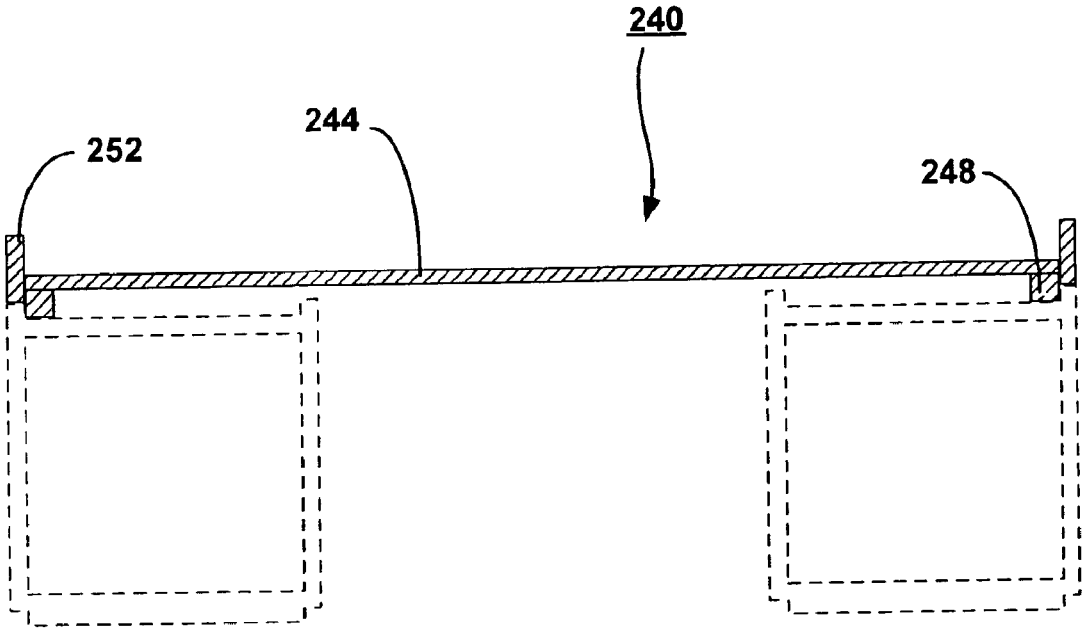
FIG. 17 is a sectional view of a mattress support adapter deployed atop two modules.

FIG. 17 shows a cross-sectional view of a mattress support adapter 240 resting atop two side modules 220. Mattress support adapter 240 has a plurality of slats 244 supported on slat rails 248 with two mattress retainer rails 252 retaining a mattress placed thereon. Mattress support adapter 240 can be constructed in sections to correspond to side modules 220 or can be made as a single unit.

Figure 18:
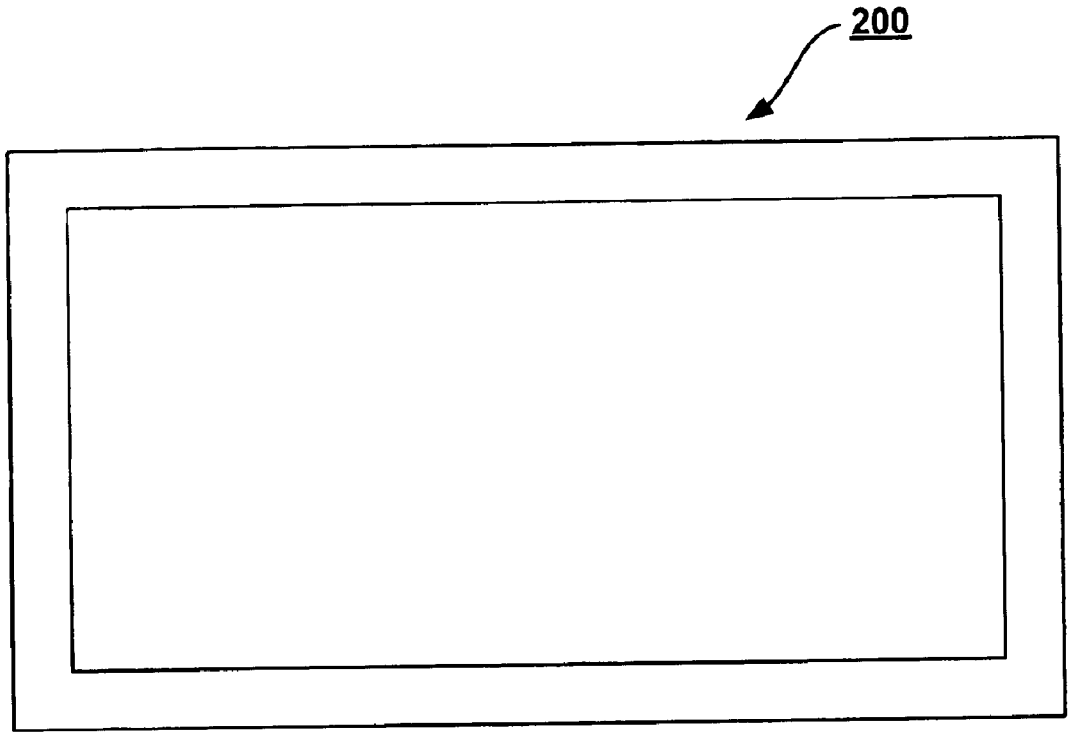
FIG. 18 is a top view of a base projection frame.

A base projection frame 200 is shown in FIG. 18. Base projection frame 200 consists of four steel tubes that are secured together in a suitable fashion to securely hold together two or more modules by placing the base projections of laterally abutting modules into the frame 200. Further, a base projection frame 200 can be dimensioned to fit around a single module to provide a decorative finish and to reduce the probability that small objects falling around the base of a module could be hidden from view under bottom wall 40. Base projection frame 200 can be constructed having one or more conduits for cabling and wiring.

Figure 19:
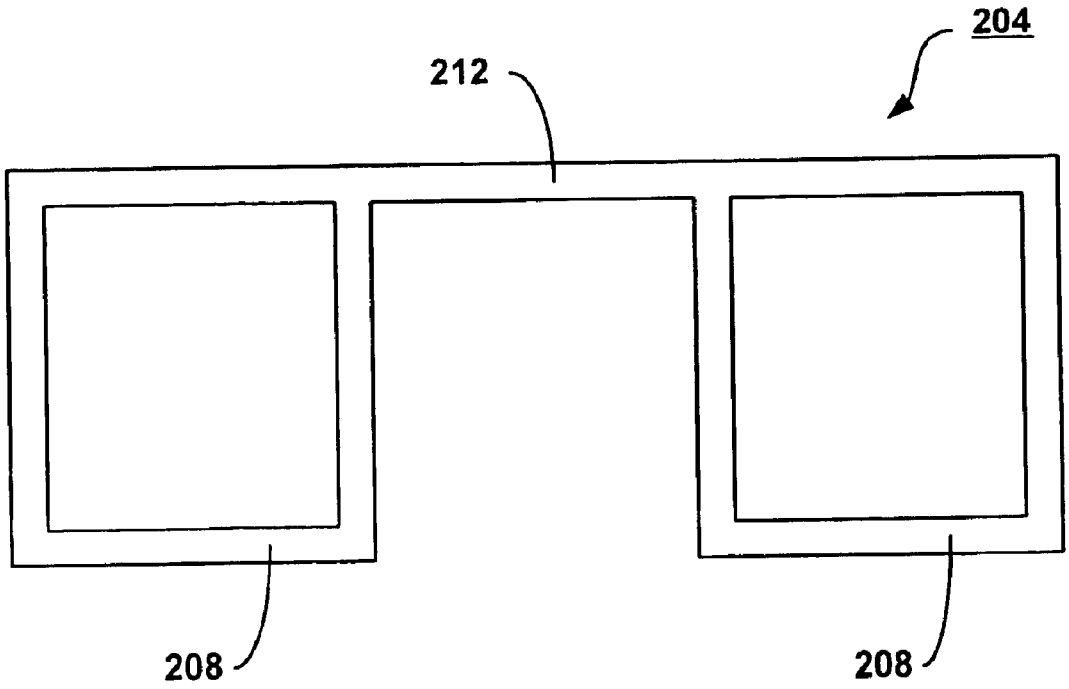
FIG. 19 is a top view of a desk base projection frame.

FIG. 19 shows a desk base projection frame 204 adapted for use with the furniture configuration of FIG. 12. Desk base projection frame 204 consists of a pair of sub-frames 208 connected by a back frame member 212. When used in conjunction with the configuration of FIG. 12, sub-frames 208 would be placed around the base projections of the pedestals and would be held a fixed distance from each other by means of back frame member 212. No frame member is provided at a front side of desk base projection frame 204 to allow a user thereof to place a chair thereunder without concern for any obstructions. Desk base projection frame 204 and working surface adapter 148 cooperate to provide structural stability to the configured desk. Desk base projection frame 204 can be also constructed to have one or more conduits for cabling and wiring.

While the embodiments discussed herein are directed to specific implementations of the invention, it will be understood that combinations, sub-sets and variations of the embodiments are within the scope of the invention. For example, while box-shaped modules have been described, modules of various other shapes will occur to those of skill in the alt, such as octagonal and hexagonal boxes, L-shaped boxes, etc. Further, the modules can be constructed without storage space therein or as a solid structure to increase structural strength.

The recesses and base projections of the modules can be any shapes that matingly correspond to each other to allow one module to interengagingly secure another module placed stacked thereon.

A number of variations on lateral cover adapter will be apparent to those skilled in the art. For example, the top retainer member can be similar to the finishing adapter. The bottom retainer member can be an L-shaped clip that is held securely under the bottom wall when the cover is pulled taut by the placement of the top retainer member.

Although retainer clips having a c-shaped cross-section have been described, it is to be understood by those of skill in the art that a number of other shaped clips can be operable to provide like functionality.

The above-described embodiments of the invention are intended to be examples of the present invention and alterations and modifications may be effected thereto, by those of skill in the art, without departing from the scope of the invention which is defined solely by the claims appended hereto.

We claim:

1. A system for providing modular furniture, comprising:

a plurality of modules, each having a front wall, a back wall, a left wall, a right wall, a top wall and a bottom wall, said top wall having one, substantially centrally located, recess which defines a lip having a first thickness, and which lip extends substantially completely around a perimeter of said top wall of said module, and said bottom wall having at least one projection offset from the edges of said wall by the distance of said first thickness in order to define an offset perimeter, and wherein said projection extends substantially completely around said offset perimeter of said bottom wall so as to correspond to and operably fit within and securely engage said recess when a first of said modules is vertically stacked atop of a second of said modules.

2. The system for providing modular furniture of claim 1, wherein said modules have at least two projections projecting from said bottom wall with at least one channel between said projections operable to receive a lip from at least two of said modules such that a first module is operable to securely engage at least two of said lips within at least one of said channels when said first module is stacked atop of two or more additional modules.

3. The system for providing modular furniture of claim 1, wherein said at least one projection is dimensioned to allow one of said modules to be placed atop and securely engage said recesses of at least two other of said modules.

4. The system for providing modular furniture of claim 1, additionally comprising:

at least one functional adapter operable to securely engage said recess of at least one module.

5. The system for providing modular furniture of claim 4, wherein said at least one functional adapter is selected from the group consisting of a seat adapter, a mattress support, a headboard adapter, a finishing adapter, lateral cover adapters, a crib adapters.

6. The system for providing modular furniture of claim 4, wherein said at least one functional adapter is selected from the group consisting of retainer clips, seat adapters, mattress support adapters, headboard adapters, table adapters, desk adapters, finishing adapters, lateral cover adapters, crib adapters, base projection frames and desk base projection frames.

7. The system for providing modular furniture of claim 1, additionally comprising:

a base projection frame operable to fit around said base projections of one or more of said modules.

8. The system for providing modular furniture of claim 7, wherein said base projection frame is operable to fit around said base projections of two or more of said modules to restrict horizontal movement of said modules.

9. A module of furniture component, comprising:

a front wall;

a back wall;

a left wall;

a right wall;

a top wall having one, substantially centrally located, recess which defines a lip having a first thickness, and which lip extends substantially completely around a perimeter of said top wall of said module, and a bottom wall having at least one projection offset from the edges of said wall by the distance of said first thickness in order to define an offset perimeter, and wherein said projection extends substantially completely around said offset perimeter of said bottom wall so as to correspond to and operably fit within and securely engage said recess in the top wall of another modular furniture component.

* * * * *